US011730674B1

(12) United States Patent
Schleicher

(10) Patent No.: US 11,730,674 B1
(45) Date of Patent: Aug. 22, 2023

(54) DEVICES FOR TRACKING OPENING AND CLOSING OF CONTAINERS

(71) Applicant: Verily Life Sciences LLC, South San Francisco, CA (US)

(72) Inventor: Brett Schleicher, San Francisco, CA (US)

(73) Assignee: Verily Life Sciences LLC, South San Francisco, CA (US)

( * ) Notice: Subject to any disclaimer, the term of this patent is extended or adjusted under 35 U.S.C. 154(b) by 126 days.

(21) Appl. No.: 16/996,092

(22) Filed: Aug. 18, 2020

Related U.S. Application Data

(60) Provisional application No. 62/889,668, filed on Aug. 21, 2019.

(51) Int. Cl.

| | |
|---|---|
| ***A61J 1/14*** | (2023.01) |
| ***A61J 1/03*** | (2023.01) |
| ***A61J 7/04*** | (2006.01) |
| ***B65D 51/24*** | (2006.01) |

(52) U.S. Cl.
CPC ..... *A61J 1/03* (2013.01); *A61J 7/0436* (2015.05); *B65D 51/245* (2013.01); *A61J 2200/70* (2013.01); *B65D 2203/10* (2013.01)

(58) Field of Classification Search
CPC ..... A61J 2200/70; A61J 1/03; A61J 7/0436; A61J 1/18; A61J 7/0076; B65D 51/245
USPC ..... 206/528, 534
See application file for complete search history.

(56) References Cited

U.S. PATENT DOCUMENTS

| | | | | |
|---|---|---|---|---|
| 7,269,476 | B2 | 9/2007 | Ratnakar | |
| 8,067,935 | B2 * | 11/2011 | Burrows | A61J 7/0436 215/230 |
| 9,445,972 | B2 | 9/2016 | Arad et al. | |
| 10,071,023 | B2 | 9/2018 | Stein et al. | |
| 2013/0222135 | A1 * | 8/2013 | Stein | A61J 7/0409 222/23 |
| 2013/0318607 | A1 * | 11/2013 | Reed | G06F 11/3093 726/23 |
| 2015/0095047 | A1 * | 4/2015 | Burrows | A61J 7/0436 206/534 |
| 2016/0048657 | A1 * | 2/2016 | LeBrun | A61J 1/1412 705/2 |
| 2016/0120758 | A1 | 5/2016 | Pi et al. | |
| 2016/0342942 | A1 * | 11/2016 | Rice | G06Q 10/0832 |
| 2018/0263854 | A1 * | 9/2018 | Taylor | A61J 7/0436 |
| 2018/0280246 | A1 * | 10/2018 | Cohen | A61J 7/0427 |
| 2018/0296441 | A1 | 10/2018 | Roham et al. | |
| 2018/0319570 | A1 | 11/2018 | Baarman et al. | |
| 2019/0209433 | A1 * | 7/2019 | Fateh | A61J 1/16 |
| 2019/0262230 | A1 * | 8/2019 | Bentkovski | B65D 50/00 |
| 2019/0298607 | A1 * | 10/2019 | Kaplan | A61J 7/0436 |
| 2019/0374438 | A1 * | 12/2019 | Dellimore | A61J 13/00 |

(Continued)

*Primary Examiner* — Robert Poon
(74) *Attorney, Agent, or Firm* — Kilpatrick Townsend & Stockton LLP

(57) ABSTRACT

Systems and devices for tracking the opening and closing of a container are provided. According to an aspect of the invention, a device includes a body that is configured to be inserted between a container and a cap that is configured to seal the container, a sensor that is configured to measure a state of the cap as being opened or closed, a microprocessor that is configured to receive a signal from the sensor that represents the state of the cap, and a transmitter that is configured to send a message that indicates the state of the cap.

16 Claims, 11 Drawing Sheets

(56) References Cited

U.S. PATENT DOCUMENTS

| | | | | |
|---|---|---|---|---|
| 2021/0007937 | A1* | 1/2021 | Amoyal | A61J 7/0418 |
| 2021/0030625 | A1* | 2/2021 | Houghton | A61J 7/0436 |

* cited by examiner

DEVICES FOR TRACKING OPENING AND CLOSING OF CONTAINERS

CROSS-REFERENCE TO RELATED APPLICATIONS

This application claims priority to U.S. Provisional Patent Application No. 62/889,668, filed on Aug. 21, 2019, titled "Devices for Tracking Opening and Closing of Containers," the contents of which are hereby incorporated by reference in their entirety for all purposes.

BACKGROUND OF THE INVENTION

Determining when a container has been opened or closed is useful for various applications. For example, medication adherence programs may determine when a patient has taken a pill by tracking when a pill bottle has been opened and closed. Some related art devices use expensive customized pill bottles to provide this information. Therefore, it would be advantageous to provide a low-cost device that is scalable to a variety of containers, and can be used with a container without modifying the container or with only minor modifications to the container.

SUMMARY OF THE INVENTION

Exemplary embodiments of the invention provide systems and methods for tracking the opening and closing of containers. According to an aspect of the invention, a device includes a body that is configured to be inserted between a container and a cap that is configured to seal the container, a sensor that is configured to measure a state of the cap as being opened or closed, a microprocessor that is configured to receive a signal from the sensor that represents the state of the cap, and a transmitter that is configured to send a message that indicates the state of the cap.

The sensor may include a switch that is arranged on the body. The switch may be a membrane switch that is activated by compression. Alternatively, the switch may be an electrical switch that is activated by electrical contact. The switch may be configured to contact a conductive element that is arranged on the container when the state of the cap is closed.

The sensor may include a plurality of switches that are arranged circumferentially on the body, such that a space is formed between each adjacent pair of the plurality of switches. The microprocessor may determine the state of the cap as being opened or closed if at least two switches of the plurality of switches indicate the same state of the cap.

The body may have a disk shape and may be configured to be affixed to the cap by at least one of adhesive, friction, or threading. Alternatively, the body may have a cylindrical shape and be configured to sit within the container.

According to another aspect of the invention, a system includes a container, a cap that is configured to seal the container, and the device described above. The system may also include a conductive seal having a central portion that covers an opening of the container and an outer portion that covers an upper circumference of the container. The sensor may be configured to contact at least one of the central portion of the conductive seal or the outer portion of the conductive seal when the state of the cap is closed. Alternatively or in addition, the system may include a conductive material that is arranged on an upper circumference and/or a threading of the container. The sensor may be configured to contact the conductive material when the state of the cap is closed.

Other objects, advantages, and novel features of the present invention will become apparent from the following detailed description of the invention when considered in conjunction with the accompanying drawings.

BRIEF DESCRIPTION OF THE DRAWINGS

The present disclosure is described in conjunction with the appended figures.

DETAILED DESCRIPTION OF THE INVENTION

Figure 1:
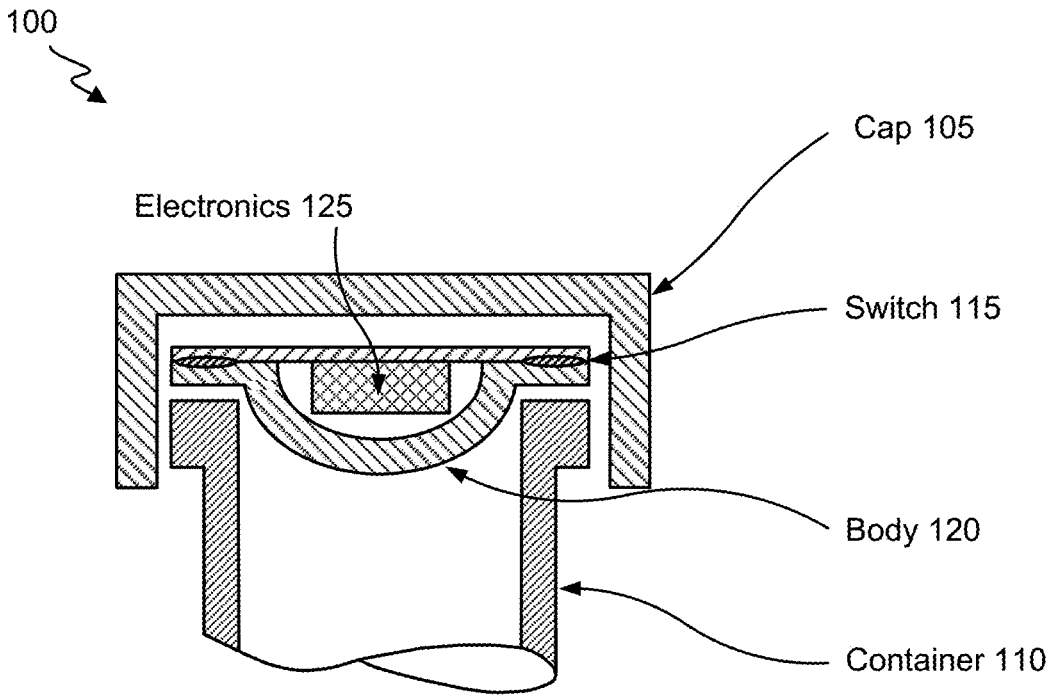
FIG. 1 shows a schematic diagram of a system for tracking the opening and closing of a container according to exemplary embodiments of the invention.

FIG. 1 shows a schematic diagram of a system 100 for tracking the opening and closing of a container according to exemplary embodiments of the invention. As shown in FIG. 1, the system 100 includes a cap 105 that is configured to seal a container 110. For example, the container 110 may be a pill bottle that stores a patient's prescription medication. The system 100 also includes a device having a body 120 that is configured to be inserted between the cap 105 and the container 110. In this example, the body 120 has a disk-like shape and may be affixed to the cap 105 by various methods, such as adhesive, friction, and/or threading. For example, the body 120 may have tabs that catch on threads on the inside surface of the cap 105. The device also includes at least one switch 115 that is configured to determine whether the cap 105 is opened or closed. In addition, the device includes electronics 125 that receive and process a signal from the switch 115. For example, the electronics 125 may include a microprocessor that receives a signal from the switch 115 that represents the state of the cap 105 as being opened or closed, and a transmitter that sends a message that includes the state of the cap 105. The electronics 125 may also include a power source, such as a battery or a solar cell. Further, the electronics 125 may include a memory that stores data about the state of the cap 105. In addition, the electronics 125 may include a device, such as an optical sensor, a time-of-flight ultrasound device, or a capacitive sensor, that detects how many pills are in the bottle. Further, the electronics 125 may include a sensor that determines a level of a liquid in the bottle.

Figure 2:
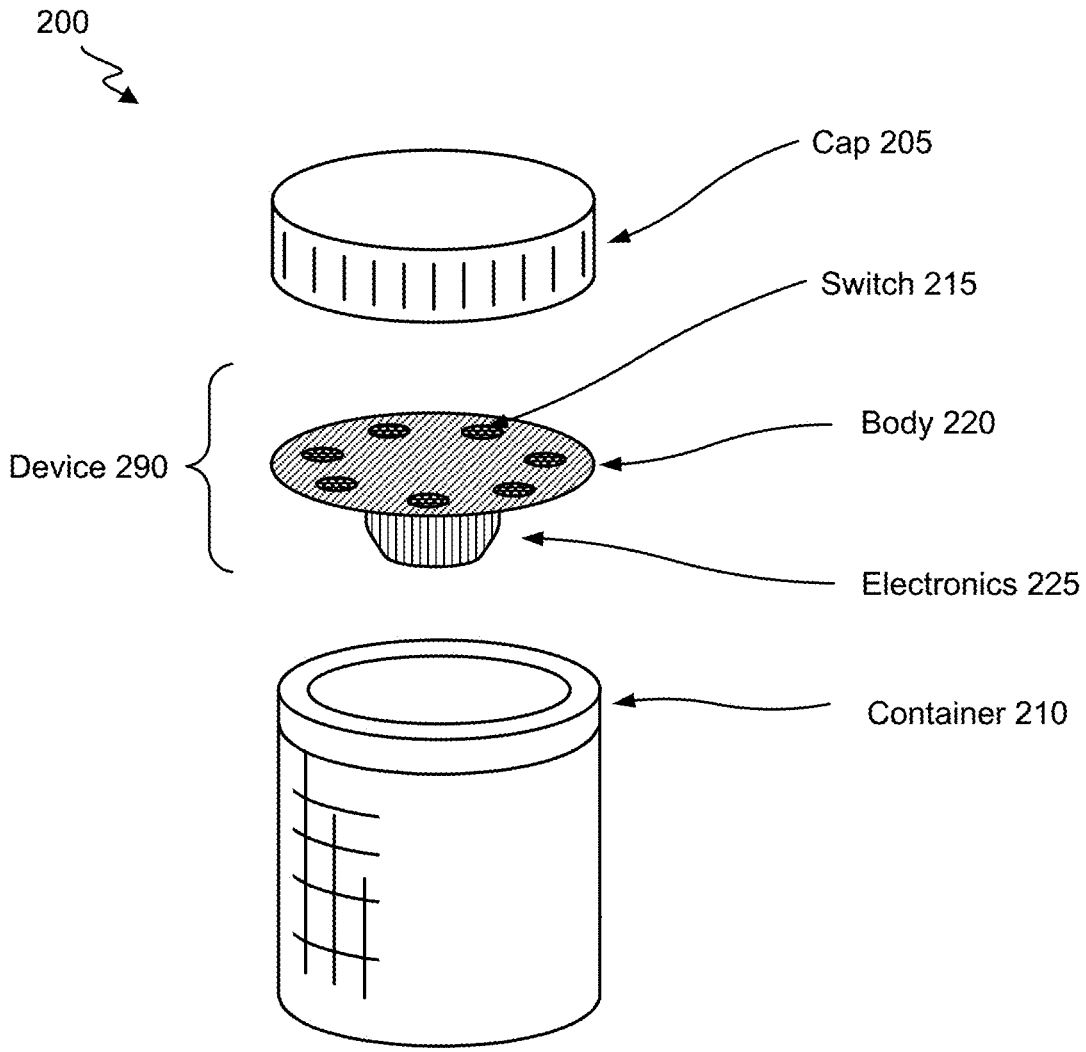
FIG. 2 shows an exploded view of a system for tracking the opening and closing of a container according to exemplary embodiments of the invention.

FIG. 2 shows an exploded view of a system 200 for tracking the opening and closing of a container according to exemplary embodiments of the invention. As shown in FIG. 2, the system 200 includes a cap 205 that is configured to seal a container 210. The system 200 also includes a device 290 having a body 220 that is configured to be inserted between the cap 205 and the container 210. Similar to the example shown in FIG. 1, the body 220 has a disk-like shape and may be affixed to the cap 205 by various methods, such as adhesive, friction, and/or threading. The device 290 also includes at least one switch 215 that is configured to determine whether the cap 205 is opened or closed. In this example, the device 290 includes a plurality of switches 215 that are arranged circumferentially on the body 220, such that a space is formed between each adjacent pair of the plurality of switches 215. A microprocessor within the electronics 225 may determine that the cap 205 is opened or closed if at least two switches of the plurality of switches 215 indicate the same state of the cap 205. This may prevent an erroneous reading if a user inadvertently contacts only one of the switches 215 while handling the device 290.

Figure 3:
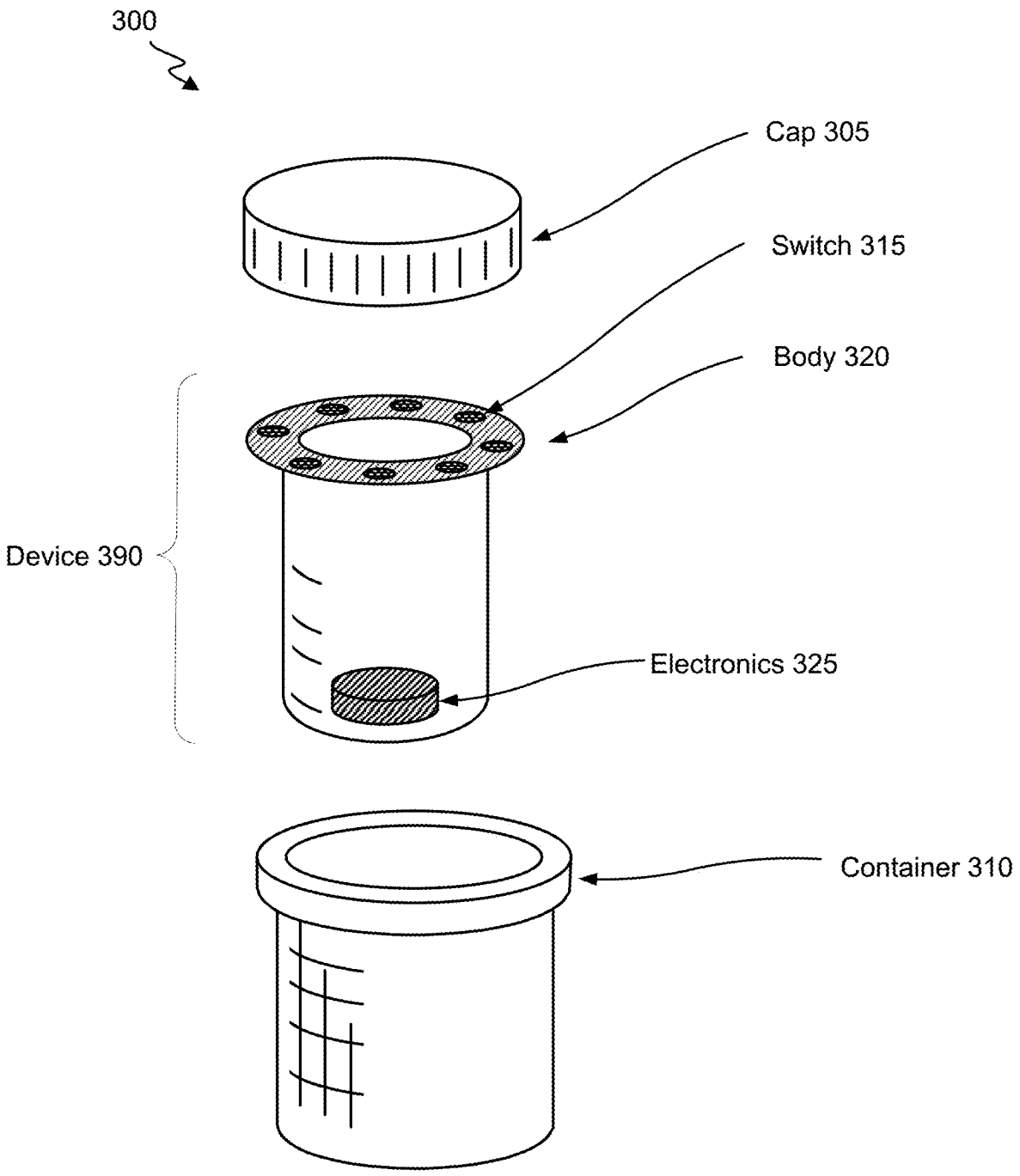
FIG. 3 shows an exploded view of another system for tracking the opening and closing of a container according to exemplary embodiments of the invention.

FIG. 3 shows an exploded view of another system 300 for tracking the opening and closing of a container according to exemplary embodiments of the invention. As shown in FIG. 3, the system 300 includes a cap 305 that is configured to seal a container 310. The system 300 also includes a device 390 having a body 320 that is configured to be inserted between the cap 305 and the container 310. In this example, the body 320 has a cylindrical shape and is configured to sit within the container 310. The device 390 also includes at least one switch 315 that is configured to determine whether the cap 205 is opened or closed. In addition, the device 390 includes electronics 325 that receive and process a signal from the switch 315. Because the electronics 325 are arranged at the base of the body 320, the electronics 325 may include a weight sensor to determine the number of pills in the container 310.

Figure 4:
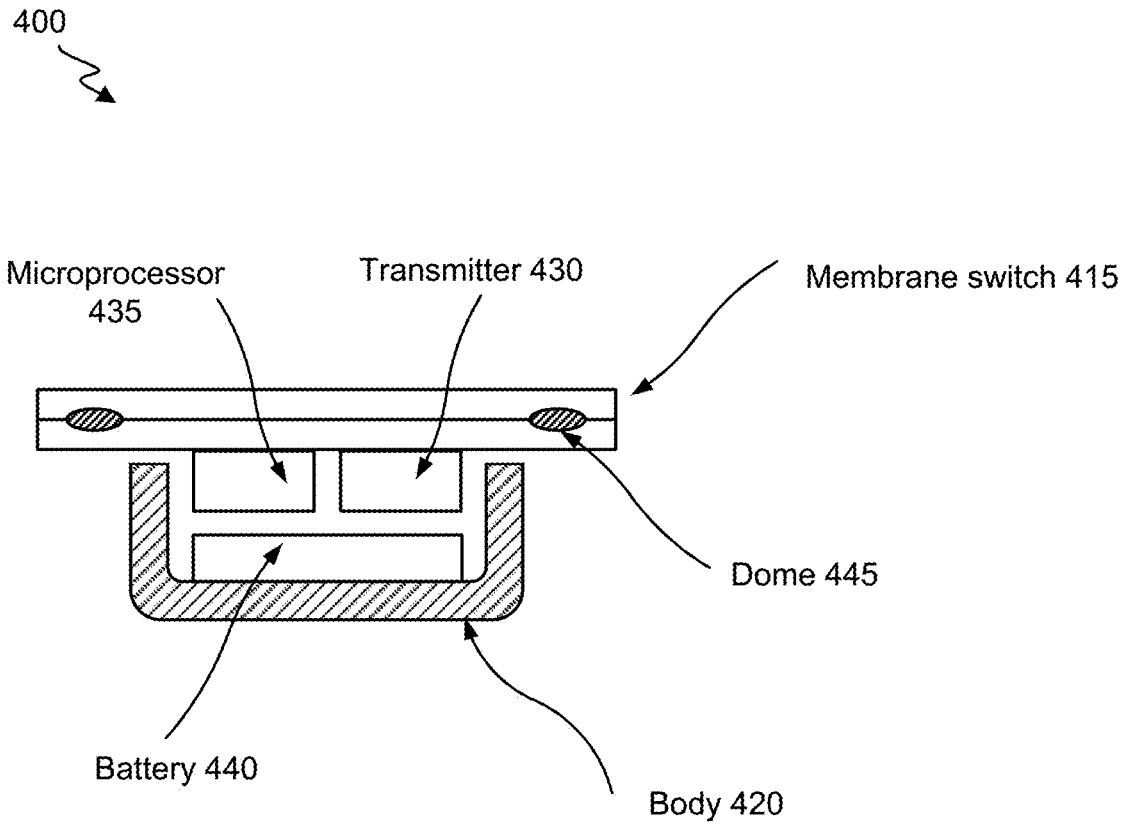
FIG. 4 shows a schematic diagram of a device for tracking the opening and closing of a container according to exemplary embodiments of the invention.

FIG. 4 shows a schematic diagram of a device 400 for tracking the opening and closing of a container according to exemplary embodiments of the invention. The device 400 includes a body 420 that contains a transmitter 430, a microprocessor 435, and a battery 440. The device 400 also includes a membrane switch 415 that is configured to determine whether a cap is opened or closed. The membrane switch 415 is activated by compression, such that the membrane switch 415 determines that the cap is closed when a compressive pressure is applied to the membrane switch 415. The membrane switch 415 may be formed by printed circuit board (PCB) technology. In addition, the device 400 may include at least one dome 445 that provides a tactile sensation when the cap is opened or closed. For example, the dome 445 may be a raised metal component that clicks or snaps when the cap is opened or closed. The microprocessor 435 receives a signal from the membrane switch 415 indicating the state of the cap, and the transmitter 430 sends a message that indicates the state of the cap. The transmitter 430 may send the message to various devices, such as smartphones, smartwatches, data hubs, and personal computers. The transmitter 430 may send the message by various wireless communication technologies, such as Bluetooth, WiFi, RFID, or cellular networks.

Figure 5A:
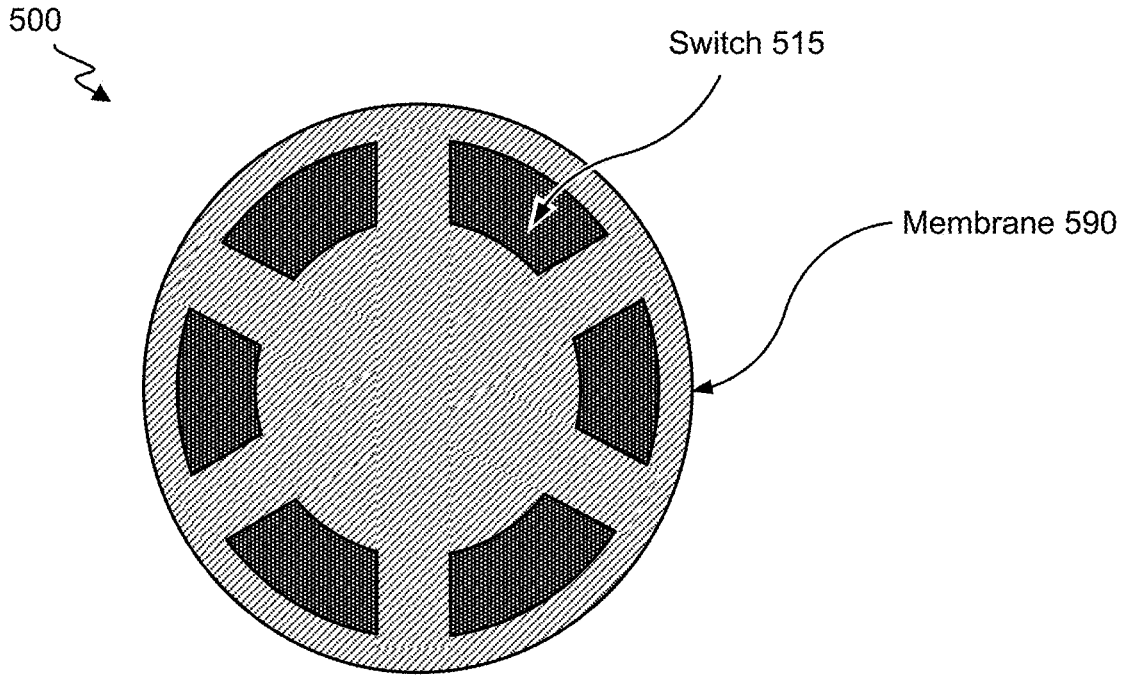
FIGS. 5A-5E show top views of membrane switches for tracking the opening and closing of a container according to exemplary embodiments of the invention.
Figure 5B:
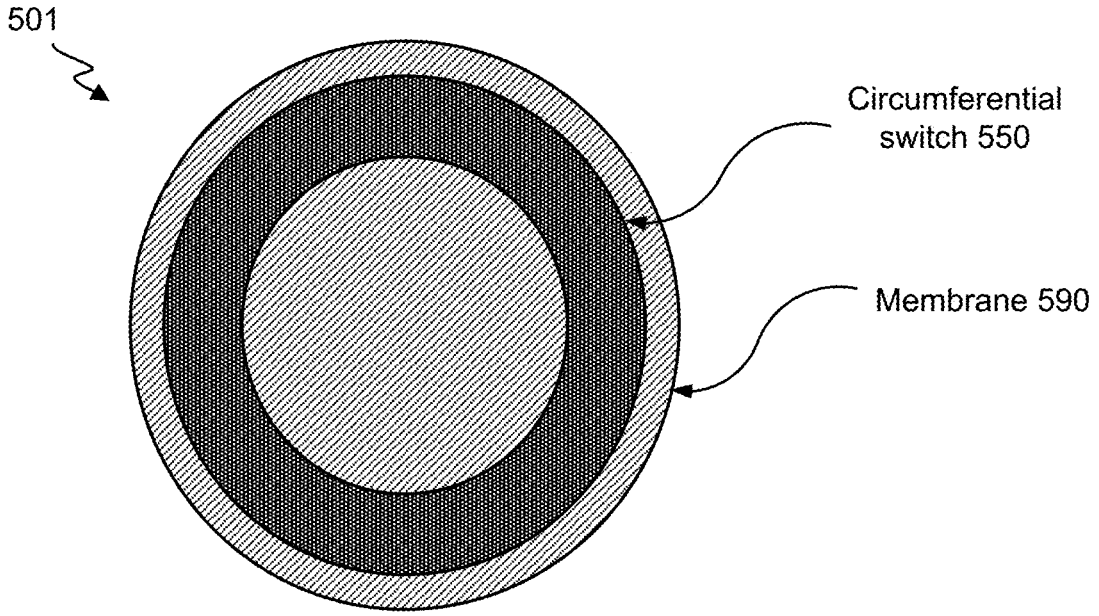

FIGS. 5A and 5B show top views of membrane switches 500 and 501, respectively, for tracking the opening and closing of a container according to exemplary embodiments of the invention. As shown in FIG. 5A, the membrane switch 500 may include a plurality of switches 515 and a membrane 590. The plurality of switches 515 may be arranged along the circumference of the membrane 590 with spaces between adjacent switches of the plurality of switches 515. The switches 515 may be activated by compression, such that the switches 515 determine that the cap is closed when a compressive pressure is applied to the switches 515. Each of the plurality of switches 515 may measure the state of the cap independently. Alternatively, as shown in FIG. 5B, the membrane switch 501 may include a single circumferential switch 550 that extends along the circumference of the membrane 590. The circumferential switch 550 may be activated by compression, such that the circumferential switch 550 determines that the cap is closed when a compressive pressure is applied to the circumferential switch 550. The membrane switches 500 and 510 may also include various other components, such as graphic overlays or light-emitting diodes (LEDs).

Figure 5C:
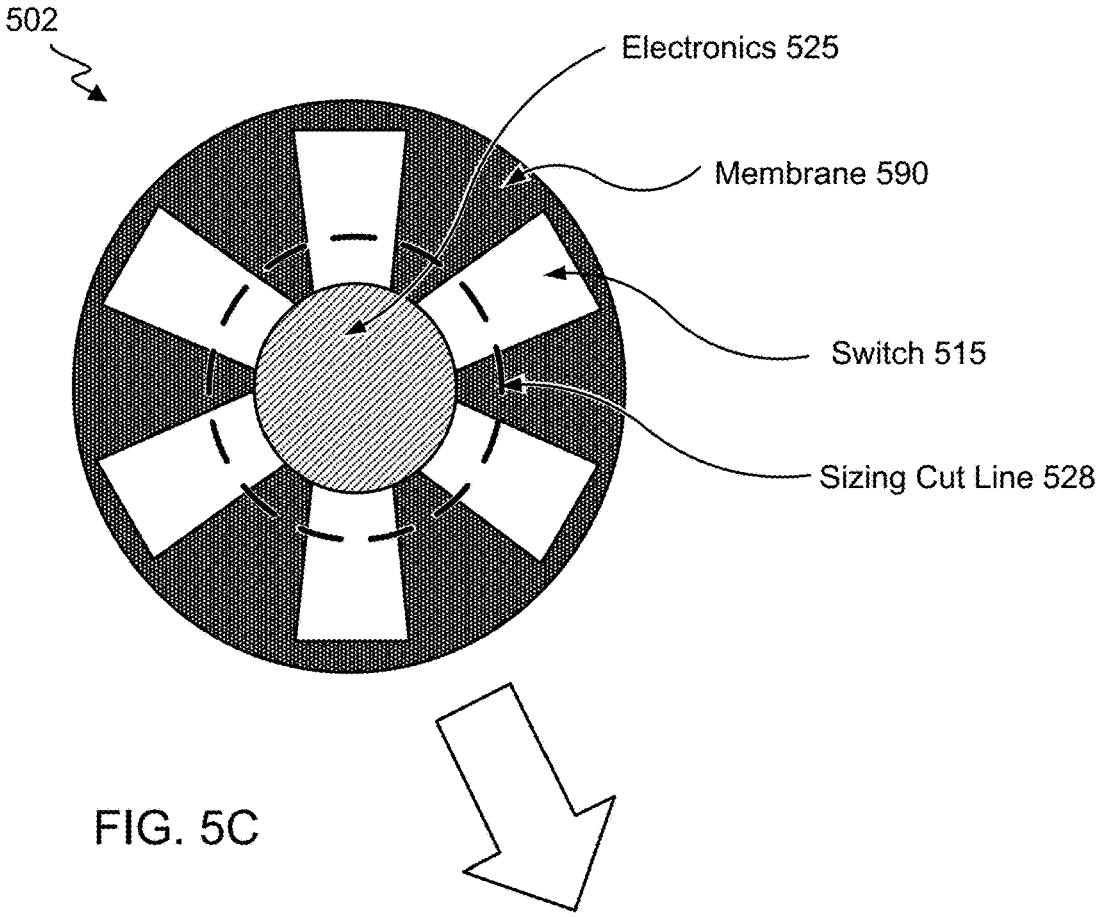
Figure 5D:
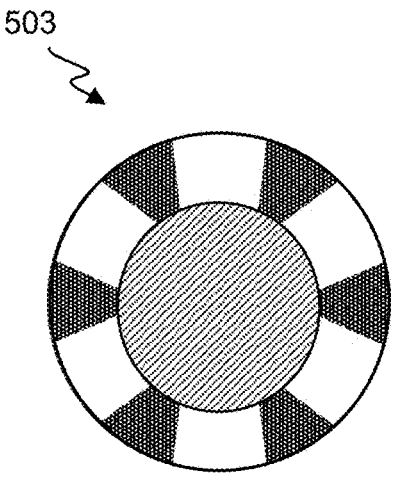
Figure 5E:
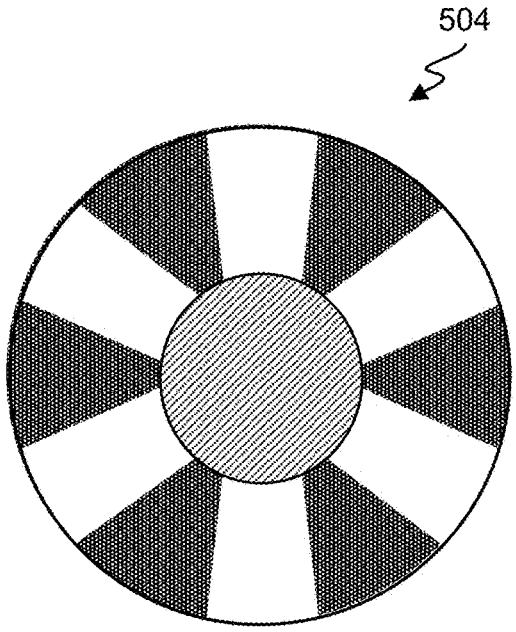

FIGS. 5C-5E show top views of membrane switches 502, 503, and 504, respectively, for tracking the opening and closing of a container according to exemplary embodiments of the invention. As shown in FIG. 5C, the membrane switch 502 may include electronics 525, a plurality of switches 515, and a membrane 590. A sizing cut line 528 may be provided to indicate where to cut the membrane switch 502. The membrane switch 502 may be cut to different sizes in order to accommodate different sized containers. For example, if the membrane switch 502 is cut along the sizing cut line 528, the resulting membrane switch 503 shown in FIG. 5D will be sized to fit smaller containers. On the other hand, if the membrane switch 502 is cut along a different line having a greater circumference than the sizing cut line 528, the resulting membrane switch 504 shown in FIG. 5E will be sized to fit larger containers.

Figure 6:
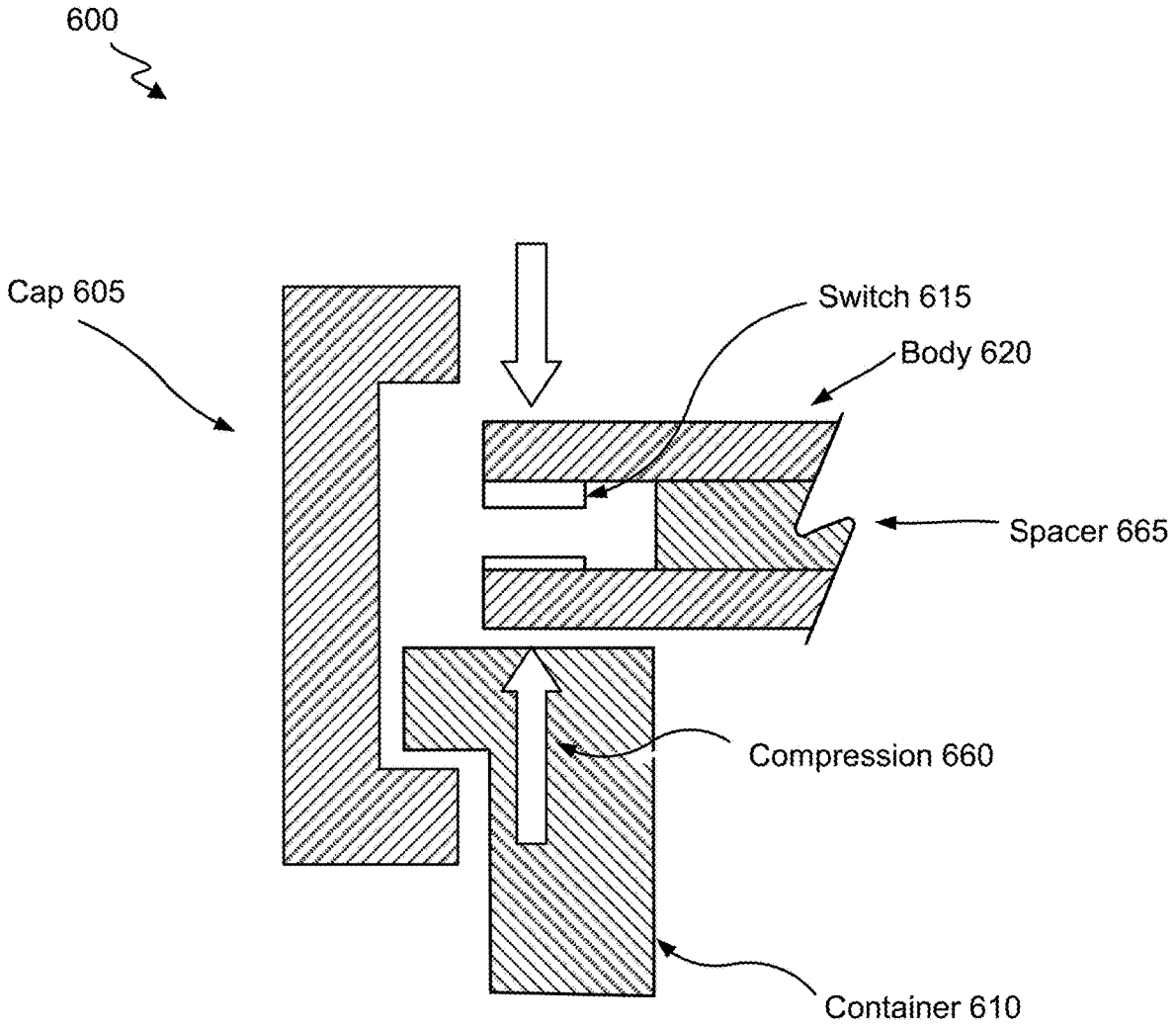
FIG. 6 shows a schematic diagram of a system for tracking the opening and closing of a container according to exemplary embodiments of the invention.

FIG. 6 shows a schematic diagram of a system 600 for tracking the opening and closing of a container according to exemplary embodiments of the invention. As shown in FIG. 6, the system 600 includes a cap 605 that is configured to seal a container 610. For example, the container 610 may be a pill bottle that stores a patient's prescription medication. The system 600 also includes a device having a body 620 that is configured to be inserted between the cap 605 and the container 610. The device also includes at least one switch 615 that is configured to determine whether the cap 605 is opened or closed. In this example, the body 620 includes a spacer 665 that provides a space between opposing switches 615. The switches 615 may be activated by compression 660, indicated by upward and downward arrows in this example, such that the switches 615 determine that the cap is closed when a compressive pressure is applied to the switches 615. The compression 660 may be applied in various directions, such as the vertical direction as shown in FIG. 6 or the horizontal direction. Alternatively, the spacer 665 may be made of a force sensitive resistor, such that when the compression 660 is applied, the resistance of the spacer 665 changes.

Figure 7:
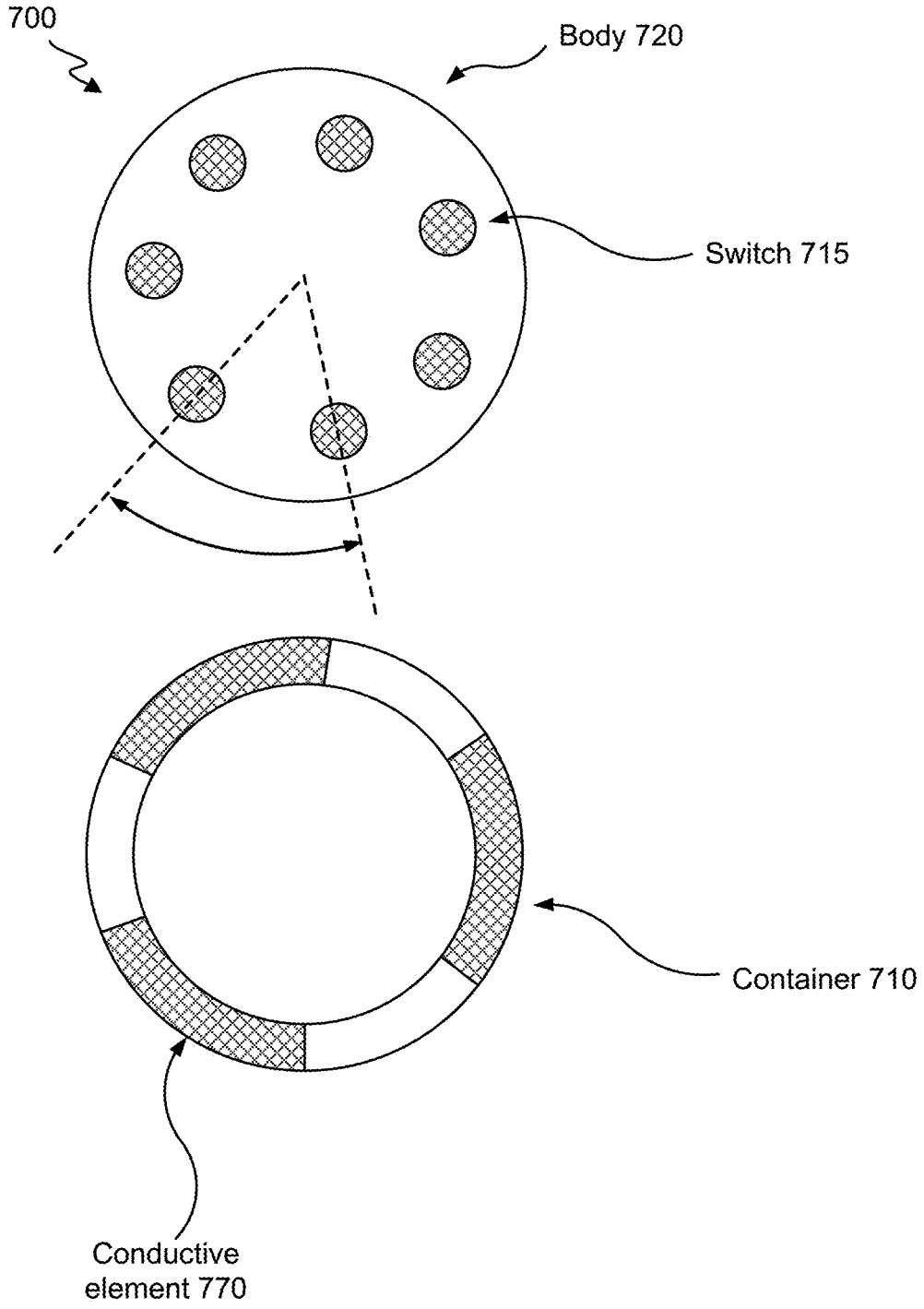
FIG. 7 shows a schematic diagram of another system for tracking the opening and closing of a container according to exemplary embodiments of the invention.

FIG. 7 shows a schematic diagram of another system 700 for tracking the opening and closing of a container according to exemplary embodiments of the invention. As shown in FIG. 7, the system 700 includes a plurality of switches 715 that are arranged on a body 720. The switches 715 may be arranged along a circumference of the body 720, and a space may be formed between adjacent pairs of the switches 715. The switches 715 may be electrical switches that are activated by electrical contact. The body 720 is configured to be inserted between a container 710 and a cap that is configured to seal the container 710. In this example, the container 710 includes a conductive element 770 that is formed on a top surface of the container 710. The conductive element 770 may be formed as segments such that two or more of the switches 715 close an electrical circuit with one of the segments of the conductive element 770 when the cap is closed. The conductive element 770 may be rotationally indexed to indicate when the cap is fully closed. The conductive element 770 may be made of various materials, such as conductive paint, conductive ink, or a conductive polymer.

Figure 8:
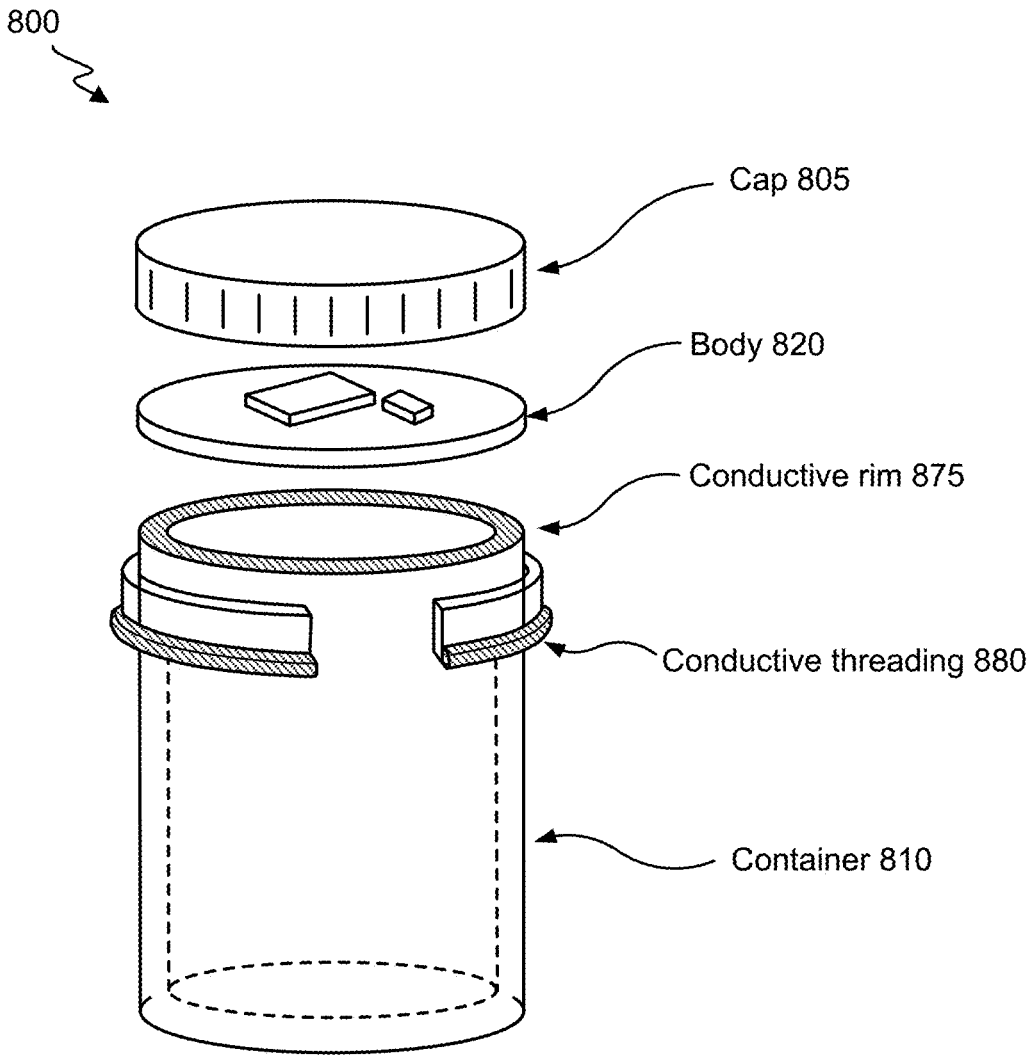
FIG. 8 shows an exploded view of another system for tracking the opening and closing of a container according to exemplary embodiments of the invention.

FIG. 8 shows an exploded view of another system 800 for tracking the opening and closing of a container according to exemplary embodiments of the invention. As shown in FIG. 8, the system 800 includes a cap 805 that is configured to seal a container 810. The system 800 also includes a device having a body 820 that is configured to be inserted between the cap 805 and the container 810. Similar to the example shown in FIG. 1, the body 820 has a disk-like shape and may be affixed to the cap 805 by various methods, such as adhesive, friction, and/or threading. A plurality of electrical switches (not shown) are formed on the underside of the body 820. The plurality of electrical switches may be arranged in a manner similar to the switches 715 that are shown in FIG. 7. Alternatively, a single electrical switch may be used. The plurality of electrical switches are configured to determine whether the cap 805 is opened or closed. In this example, the plurality of switches are configured to make electrical contact with a conductive rim 875 on the top circumferential surface of the container 810 and/or a conductive threading 880 on a circumferential threading pattern on the outside of the container 810. The conductive rim 875 and/or the conductive threading 880 may be formed by various components, such as an insert molding, metallic paint, foil applique, conductive plastic, or conductive imprinting.

Figure 9:
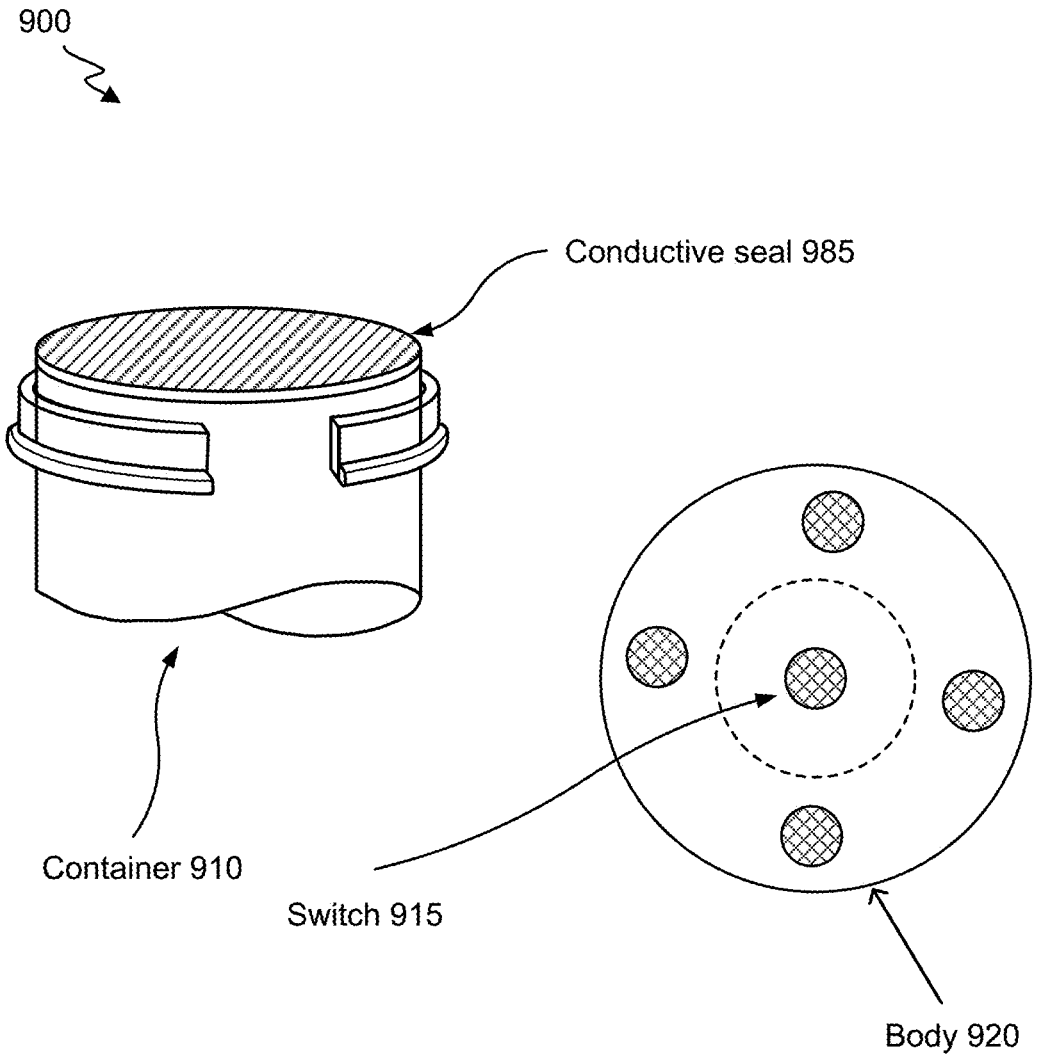
FIG. 9 shows a schematic diagram of another system for tracking the opening and closing of a container according to exemplary embodiments of the invention.

FIG. 9 shows a schematic diagram of another system 900 for tracking the opening and closing of a container according to exemplary embodiments of the invention. As shown in FIG. 9, the system 900 includes a plurality of switches 915 that are arranged on a body 920. Some of the switches 915 may be arranged along a circumference of the body 920, and a space may be formed between adjacent pairs of the switches 915. Another switch 915 may be arranged on an interior section of the body 920. The switches 915 may be electrical switches that are activated by electrical contact. The body 920 is configured to be inserted between a container 910 and a cap that is configured to seal the container 910. In this example, the container 910 includes a conductive seal 985 that is formed to cover an opening of the container 710. The conductive seal 985 may be made of a metallic foil. When the conductive seal 985 is in place, each of the switches 915 contact the conductive seal 985 when the cap is closed. When a user needs to access the pills within the container 910, the user removes a portion of the conductive seal 985 from the container 910. A portion of the conductive seal 985 may remain on the top circumferential surface of the container 910, such that the switches 915 that are arranged along the circumference of the body 920 may contact the remaining portion of the conductive seal 985. This example may be used to track whether a portion of the conductive seal 985 has been removed, as well as whether the cap is opened or closed.

Figure 10:
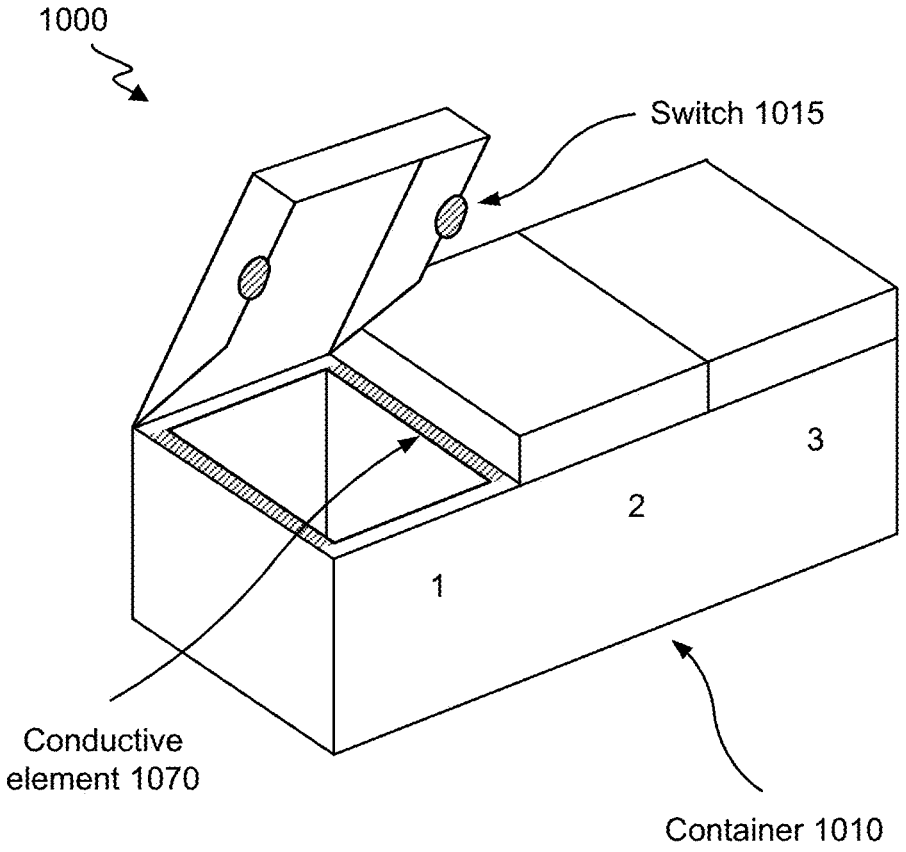
FIG. 10 shows a schematic diagram of another system for tracking the opening and closing of a container according to exemplary embodiments of the invention.

FIG. 10 shows a schematic diagram of another system 1000 for tracking the opening and closing of a container according to exemplary embodiments of the invention. As shown in FIG. 10, the system 1000 may include a container 1010 having individually instrumented boxes 1, 2, and 3. Within each box, a switch 1015 may be configured to make electrical contact with a conductive element 1070 when the box is closed. The switch 1015 may be an electrical switch.

Specific details are given in the above description to provide a thorough understanding of the embodiments. However, it is understood that the embodiments can be practiced without these specific details. For example, circuits can be shown in block diagrams in order not to obscure the embodiments in unnecessary detail. In other instances, well-known circuits, processes, algorithms, structures, and techniques can be shown without unnecessary detail in order to avoid obscuring the embodiments.

Implementation of the techniques, blocks, steps and means described above can be done in various ways. For example, these techniques, blocks, steps and means can be implemented in hardware, software, or a combination thereof. For a hardware implementation, the processing units can be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described above, and/or a combination thereof.

Also, it is noted that the embodiments can be described as a process which is depicted as a flowchart, a flow diagram, a data flow diagram, a structure diagram, or a block diagram. Although a flowchart can describe the operations as a sequential process, many of the operations can be performed in parallel or concurrently. In addition, the order of the operations can be re-arranged. A process is terminated when its operations are completed, but could have additional steps not included in the figure. A process can correspond to a method, a function, a procedure, a subroutine, a subprogram, etc. When a process corresponds to a function, its termination corresponds to a return of the function to the calling function or the main function.

Furthermore, embodiments can be implemented by hardware, software, scripting languages, firmware, middleware, microcode, hardware description languages, and/or any combination thereof. When implemented in software, firmware, middleware, scripting language, and/or microcode, the program code or code segments to perform the necessary tasks can be stored in a machine readable medium such as a storage medium. A code segment or machine-executable instruction can represent a procedure, a function, a subprogram, a program, a routine, a subroutine, a module, a software package, a script, a class, or any combination of instructions, data structures, and/or program statements. A code segment can be coupled to another code segment or a hardware circuit by passing and/or receiving information, data, arguments, parameters, and/or memory contents. Information, arguments, parameters, data, etc. can be passed, forwarded, or transmitted via any suitable means including memory sharing, message passing, ticket passing, network transmission, etc.

For a firmware and/or software implementation, the methodologies can be implemented with modules (e.g., procedures, functions, and so on) that perform the functions described herein. Any machine-readable medium tangibly embodying instructions can be used in implementing the methodologies described herein. For example, software codes can be stored in a memory. Memory can be implemented within the processor or external to the processor. As used herein the term "memory" refers to any type of long term, short term, volatile, nonvolatile, or other storage medium and is not to be limited to any particular type of memory or number of memories, or type of media upon which memory is stored.

Moreover, as disclosed herein, the term "storage medium" can represent one or more memories for storing data, including read only memory (ROM), random access memory (RAM), magnetic RAM, core memory, magnetic disk storage mediums, optical storage mediums, flash memory devices and/or other machine readable mediums for storing information. The term "machine-readable medium" includes but is not limited to portable or fixed storage devices, optical storage devices, wireless channels, and/or various other storage mediums capable of storing that contain or carry instruction(s) and/or data.

While the principles of the disclosure have been described above in connection with specific apparatuses and methods, it is to be clearly understood that this description is made only by way of example and not as limitation on the scope of the disclosure.

What is claimed is:

1. A device comprising:

a body that is configured to be inserted between a container and a cap that is configured to seal the container, wherein the body comprises a top face;

a sensor disposed on the body that is configured to measure a state of the cap as being opened or closed, wherein the sensor comprises a plurality of switches that are arranged circumferentially on the top face of the body, wherein a space is formed between each adjacent pair of switches of the plurality of switches, wherein the plurality of switches are configured to be disposed above the container;

electronics disposed below the body comprising a microprocessor that is configured to receive a signal from the sensor that represents the state of the cap; and a transmitter that is configured to send a message that indicates the state of the cap.

2. The device according to claim 1, wherein the switch is a membrane switch that is activated by compression.

3. The device according to claim 1, wherein the switch is an electrical switch that is activated by electrical contact.

4. The device according to claim 3, wherein the switch is configured to contact a conductive element that is arranged on the container when the state of the cap is closed.

5. The device according to claim 1, wherein the microprocessor determines the state of the cap as being opened or closed if at least two switches of the plurality of switches indicate the same state of the cap.

6. The device according to claim 1, wherein the body has a disk shape and is configured to be affixed to the cap by at least one of adhesive, friction, or threading.

7. The device according to claim 1, wherein the body has a cylindrical shape and is configured to sit within the container.

8. A system comprising:

a container;

a cap that is configured to seal the container; and a device comprising:

a body that is configured to be inserted between the container and the cap that is configured to seal the container, wherein the body comprises a top face;

a sensor disposed on the body that is configured to measure a state of the cap as being opened or closed, wherein the sensor comprises a plurality of switches that are arranged circumferentially on the top face of the body, wherein a space is formed between each adjacent pair of switches of the plurality of switches, wherein the plurality of switches are disposed above the container;

a microprocessor that is configured to receive a signal from the sensor that represents the state of the cap; and a transmitter that is configured to send a message that indicates the state of the cap.

9. The system according to claim 8, further comprising:

a conductive seal comprising a central portion that covers an opening of the container and an outer portion that covers an upper circumference of the container, wherein the sensor is configured to contact at least one of the central portion of the conductive seal or the outer portion of the conductive seal when the state of the cap is closed.

10. The system according to claim 8, further comprising:

a conductive material that is arranged on at least one of an upper circumference or a threading of the container, wherein the sensor is configured to contact the conductive material when the state of the cap is closed.

11. The system according to claim 8, wherein the switch is a membrane switch that is activated by compression.

12. The system according to claim 8, wherein the switch is an electrical switch that is activated by electrical contact.

13. The system according to claim 12, wherein the switch is configured to contact a conductive element that is arranged on the container when the state of the cap is closed.

14. The system according to claim 8, wherein the microprocessor determines the state of the cap as being opened or closed if at least two switches of the plurality of switches indicate the same state of the cap.

15. The system according to claim 8, wherein the body has a disk shape and is configured to be affixed to the cap by at least one of adhesive, friction, or threading.

16. The system according to claim 8, wherein the body has a cylindrical shape and is configured to sit within the container.

* * * * *